US005602802A

United States Patent [19]

Leigh-Spencer et al.

[11] Patent Number: 5,602,802

[45] Date of Patent: Feb. 11, 1997

[54] MEDICATION REMINDER SYSTEM AND APPARATUS

[75] Inventors: Peter Leigh-Spencer; James Baker, both of Edmonton, Canada

[73] Assignee: Timely Devices Inc., Alberta, Canada

[21] Appl. No.: 338,859

[22] Filed: Nov. 14, 1994

[30] Foreign Application Priority Data

Sep. 9, 1994 [CA] Canada ..... 2131783

[51] Int. Cl.[6] ..... G04B 47/00; G04C 21/16

[52] U.S. Cl. ..... 368/10; 365/66

[58] Field of Search ..... 368/10, 66, 256

[56] References Cited

U.S. PATENT DOCUMENTS

| | | | |
|---|---|---|---|
| 4,218,871 | 8/1980 | Moritani et al. | 368/10 |
| 4,310,890 | 1/1982 | Trehn et al. | 368/90 |
| 4,473,884 | 9/1984 | Behl | 368/10 |
| 4,504,153 | 3/1985 | Schollmeyer et al. | 368/10 |
| 4,682,299 | 7/1987 | McIntosh et al. | 368/10 |
| 4,690,566 | 9/1987 | Robertsen | 368/10 |
| 4,695,954 | 9/1987 | Rose et al. | 368/10 |
| 5,107,469 | 4/1992 | Dodson | 368/10 |

FOREIGN PATENT DOCUMENTS

| | | |
|---|---|---|
| 1293382 | 6/1985 | Canada . |
| 1239024 | 7/1988 | Canada . |

*Primary Examiner*—Bernard Roskoski
*Attorney, Agent, or Firm*—Oliff & Berridge

[57] ABSTRACT

The present invention relates to a medication reminder system, apparatus and method for notifying patients of the correct times during the day for taking a medicine. The system provides a portable module carried by the patient that alerts the patient to the time that a medication should be taken. The portable module is programmed by an operator at a programming station to provide the specific times for taking the medication.

5 Claims, 11 Drawing Sheets

MEDICATION REMINDER SYSTEM AND APPARATUS

FIELD OF THE INVENTION

The present invention relates to a medication reminder system, apparatus and method for notifying patients of the correct times during the day for taking a medicine. The system provides a portable module carried by the patient that alerts the patient to the time that a medication should be taken. The portable module is programmed by an operator at a programming station to provide the specific times for taking the medication.

BACKGROUND OF THE INVENTION

When medications are prescribed, a patient frequently does not follow the administration instructions included with the medication. A patient often forgets the specific time of day that the medication should be taken or miscalculates the interval between doses which results in the patient either taking medication too frequently, too infrequently or not at all. This can lead to a variety of pharmacological and/or toxicological problems to the patient which, ultimately, may result in ineffective treatment of a disease and/or harm to the patient.

When a drug is first administered, the desired concentration of the drug in the body is established by the prescribing physician at a level to provide the desired pharmacological effect. For example, in the case of an antibiotic, when the antibiotic is first administered, the concentration of the antibiotic in the body is established at a level deemed sufficient by the prescribing physician to kill off a proportion of the infecting organisms. Subsequent and regular doses of antibiotic provide the desired concentration that enables the immune system to overcome the infection. The organisms that remain after first administration of the antibiotic are the ones more resistant to the antibiotic than the ones killed by the first dose. If subsequent doses of antibiotic are not administered in a timely fashion, the concentration of the antibiotic in the blood declines and the organisms resume active growth. Typically, if normal growth resumes, it is those organisms more resistant to the antibiotic that are growing thereby reducing the effectiveness of the subsequent doses of the antibiotic.

Alternatively, in the case of a drug which may have a toxic effect in the body above a particular concentration, a patient who inadvertently takes such a medication too frequently may be deleteriously affected. Accordingly, it is very important that a patient is aware of when to take the prescribed medication and actually takes the medication at the recommended intervals.

Frequently, patients who may need to take several different medications during the course of a day, become confused both with the frequency and particular medication that needs to be taken at a particular time resulting in the above problems. These problems manifest themselves when the patient has impaired eyesight or is in a confused state of mind.

Whereas past systems have provided patient-programmable reminder systems, these systems do not address the needs of those patients, who, through a lack of manual dexterity, impaired eyesight or inability to follow written or oral instructions are either incapable of or unwilling to use these reminder devices. These reminder devices may also permit the patient to attempt to program a device by themselves leading to inappropriate reminders or frustration with the device due to the complexity of the programming task whereby the device is disregarded and not used. Furthermore, past devices may enable tampering by unauthorized individuals which again may lead to inappropriate reminders.

In some situations, optimum prescription times are not necessarily evenly spaced throughout the day but are sometimes related to metabolism rates. This requires that the interval between adjacent medications may not always be the same which precludes the use of simple "repeat cycle" timers that will time the same period each time it is reset. Past timers may also limit the duration of the alarm which turn themselves off within a certain period, usually in order to preserve battery power.

Accordingly, there has been a need for a programmable reminder system for medications where the prescribing pharmacist has the ability to program a simple portable module carried by the patient that ensures the correct information has been programmed and that also prohibits the patient's from gaining access to the stored program. There is also a need for an alarm timer that provides a "time-of-day" alarm which will continue until the alarm is acknowledged by the patient in order to provide specific times of an alarm and to help ensure compliance with the reminder. As well, there has been a need for a programmable reminder system where alarm times in the portable module remain set until de-programmed by the programming station in order to provide a continuous series of alarms until the module is returned to the pharmacist.

Furthermore, there has been a need for a programmable reminder system where a single programming station can program a plurality of portable modules in order to provide an efficient and cost-effective distribution of programming stations and portable modules for use by a pharmacist to serve numerous patients. There is also a need for a system where the cost of portable modules is low to ensure that the end cost of a medication to a user is not substantially increased by an overly expensive and/or complex module and base station.

As well, there has been a need for a programmable reminder system where the portable module can be quickly programmed by the pharmacist through the programming station with a communication link that minimizes the complexity and, hence, the cost of the portable module. It is also desirable to have a programmable reminder system that provides a long shelf-life for the batteries in the portable module where the module is put in a "sleep" mode by turning off the clock in the module when the module is not being used between patients.

As mentioned above, there are numerous programmable reminder systems that provide an indication that a specific period of time has elapsed thereby alerting a user that a specific task should be performed.

Canadian Patent 1,239,024 discloses a programmable service reminder apparatus and method for use with automobiles. This patent is not concerned with the problems of a programmable reminder system as outlined above. In particular, this patent does not disclose a central programming station and portable module programmed by the central station.

Canadian Patent 1,293,382 discloses an apparatus for alerting a patient to take medication which includes a plurality of medication compartments. This device does not disclose a separate programming station and alarm module and, furthermore, enables the patient to conduct the programming of the device.

U.S. Pat. No. 5,107,469 discloses a reflectance photometer instrument for controlled administration of insulin in diabetes management. This patent is concerned with the problems of providing a low power alarm clock functions in a microprocessor-based reflectance photometer instruments. This patent does not disclose a separate programming station and alarm module, where the alarm module is programmable by the programming station to provide time-of-day reminders. Rather this patent is concerned with a user initiated and activated alarm system that has been internally pre-programmed to notify a user to perform a specific task. This patent does not teach downloading alarm instructions to a portable module to provide an alarm which is acknowledged by a user.

U.S. Pat. No. 4,690,566 and U.S. Pat. No. 4,218,871 disclose a portable programmable timing device and electronic timer, respectively. These patents do not disclose a separate programming station that provides programming signals to the portable device.

SUMMARY OF THE INVENTION

In accordance with the invention, a medication reminder system for reminding patients to take medications is provided, the system comprising:

a portable module, the portable module having module microprocessor for receiving and storing alarm instructions from a programming station, the module microprocessor also for generating an alarm signal corresponding to the alarm instructions and for receiving an alarm silence signal;

alarm means responsive to the alarm signal for generating an alarm;

alarm silence means for signalling the module microprocessor to silence the alarm means when the alarm means is active;

module communication interface for communication with the programming station;

the programming station having programming station communication interface for communication with the module communication interface;

programming station microprocessor for programming and downloading alarm instructions to said module microprocessor through the programming station communication interface and module communication interface.

In a preferred embodiment of the invention, communication between the module communication interface and programming station communication interface is a two-way optical serial data communication link.

In a further embodiment of the invention, the portable module further comprises battery means for powering the portable microprocessor wherein the portable microprocessor further monitors battery usage by a battery usage counter, the battery usage counter responsive to elapsed time of operation of the module in a timing mode and alarm mode.

In a still further embodiment, the module further comprises a body having a lid means for engagement with a medication container.

In accordance with a further embodiment of the invention, a portable module is provided comprising:

module microprocessor for receiving and storing alarm instructions from a programming station, the module microprocessor also for generating an alarm signal corresponding to the alarm instructions and for receiving an alarm silence signal;

auditory alarm means responsive to the alarm signal for generating an auditory alarm;

visual alarm means responsive to the alarm signal for generating a visual alarm;

alarm silence means for signalling the module microprocessor to silence the auditory alarm means and visual alarm means when the auditory and visual alarm means are active;

module communication interface for communication with the programming station;

In a still further embodiment, a programming station for programming and downloading alarm data to a portable module is provided, the portable module having a module communication interface and module microprocessor comprising:

programming station communication interface for communication with the module communication interface;

programming station microprocessor for programming and downloading alarm instructions to said module microprocessor through the programming station communication interface and module communication interface.

The invention also provides a method of programming a programming station comprising the steps of:

a) establishing a communication link between the programming station communication interface and module communication interface;

b) setting a plurality of dosage times;

c) downloading said dosage times to the module microprocessor.

In a still further embodiment, the invention is directed to the use of the a medication reminder system for notifying a patient of a preprogrammed time for taking a medication.

In a more specific embodiment, the invention provides a medication reminder system for reminding patients to take medications comprising:

a portable module, the portable module having module microprocessor for receiving and storing alarm instructions from a programming station, the module microprocessor also for generating an alarm signal corresponding to the alarm instructions and for receiving an alarm silence signal;

visual alarm means responsive to the alarm signal for generating a visual alarm;

auditory alarm means responsive to the alarm signal for generating an auditory alarm;

alarm silence means for signalling the module microprocessor to silence the visual and auditory alarm means when the visual and auditory alarm means are active;

module communication interface for communication with the programming station;

the programming station having programming station communication interface for communication with the module communication interface;

programming station microprocessor for programming and downloading alarm instructions to said module microprocessor through the programming station communication interface and module communication interface.

In a specific embodiment of the invention, the invention provides a medication reminder system for reminding patients to take medications comprising:

a portable module, the portable module having module microprocessor for receiving and storing alarm instructions from a programming station, the module microprocessor also for generating an alarm signal corresponding to the alarm instructions and for receiving an alarm silence signal;

light emitting diode (LED) alarm responsive to the alarm signal for generating a visual alarm, the LED also for communication with the programming station via a two-way optical serial data communication link;

piezo alarm responsive to the alarm signal for generating an auditory alarm;

push-button switch for signalling the module microprocessor to silence the LED and piezo alarms when the LED and piezo alarms are active;

a battery for powering the portable microprocessor wherein the portable microprocessor further monitors battery usage by a battery usage counter, the battery usage counter responsive to elapsed time of operation of the module in a timing mode and alarm mode;

the programming station having programming station LED communication interface for communication with the module LED alarm wherein the portable module is received within the programming station to establish communication with the portable module;

programming station microprocessor for programming and downloading alarm instructions to the module microprocessor through the programming station communication interface and module communication interface;

display and keypad for inputting alarm instructions to the programming station microprocessor.

BRIEF DESCRIPTION OF THE DRAWINGS

These and other features of the invention will be more apparent from the following description in which reference is made to the appended drawings wherein.

DETAILED DESCRIPTION OF THE INVENTION

Figure 1:
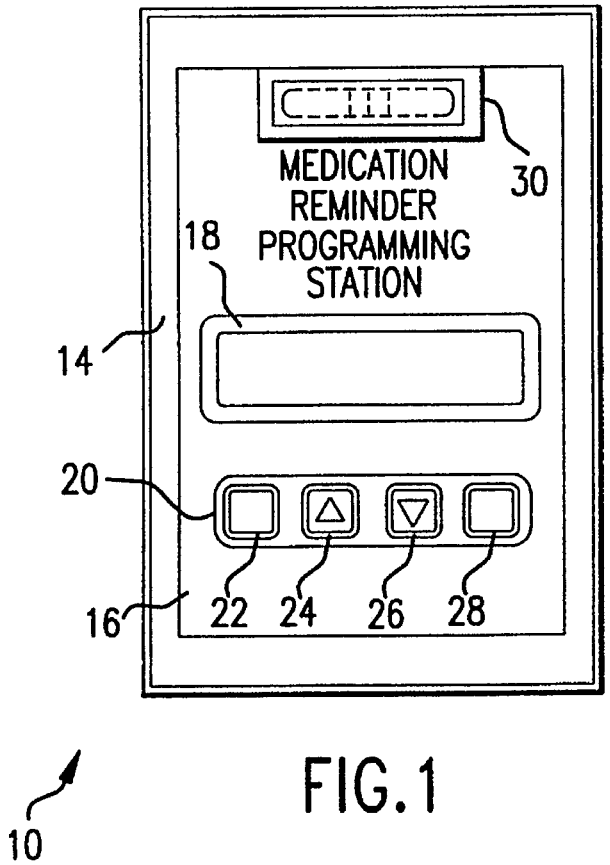
FIG. 1 is a plan view of the programming station.
Figure 1B:
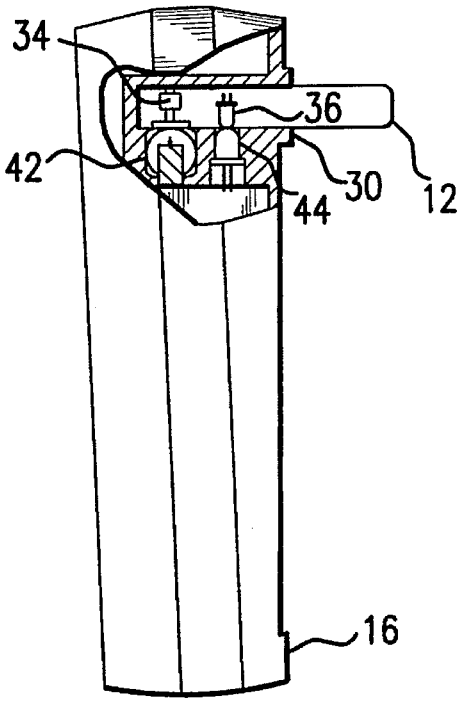
FIG. 1*b* is a cross section of the programming station showing the module engaged.
Figure 1A:
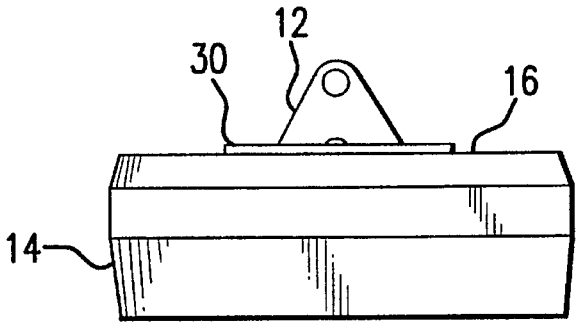
FIG. 1*a* is an end elevation of the programming station showing the module engaged.

A programming station 10 and portable module 12 are shown in FIGS. 1–5. The programming station 10 is provided with a body 14 with front panel 16 having a display 18 and keypad 20. In one embodiment of the invention, the display 18 is provided with a two-line, 16 character LCD display and the keypad 20 has a 4 button keypad labelled "Menu" or "Mode" 22, "UP" 24, "Down" 26 and "OK" 28, respectively. The front panel 16 is also provided with a receptacle 30 for receiving a module 12 in order to program the module 12 through the station 10.

Figure 2:
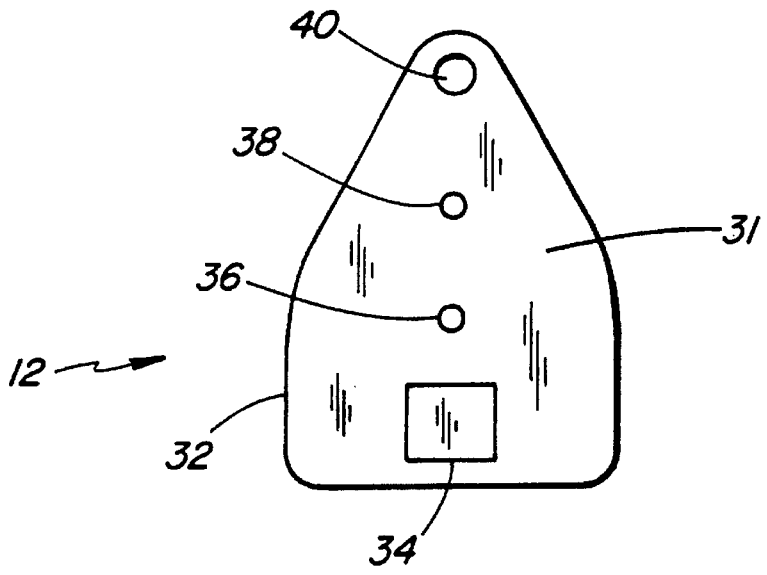
FIG. 2 is a front view of the module.
Figure 2A:
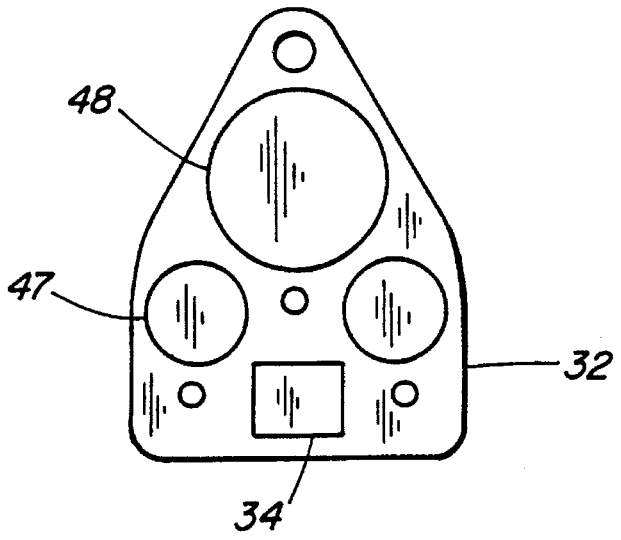
FIG. 2*a* is a front view of the module with the cover removed showing the internal components.

With reference to FIGS. 2 and 2*a*, the module 12 is provided with a body 32 having a cover 31 with push button 34, light emitting diode 36, sound port 38 and hole 40. The body 32 of the module 12 is adapted to be received within the receptacle 30 of the station 10. A communication link between the module 12 and station 10 is through LED 36 on the body 32 and LED 44 within receptacle 30. Other communication links may be used between the module 12 and station 10 such as, but not being limited to, optical, fibre-optic, acoustic, magnetic, capacitative, radio frequency, magnetic/capacitative, or electrical data transfer links.

Figure 3:
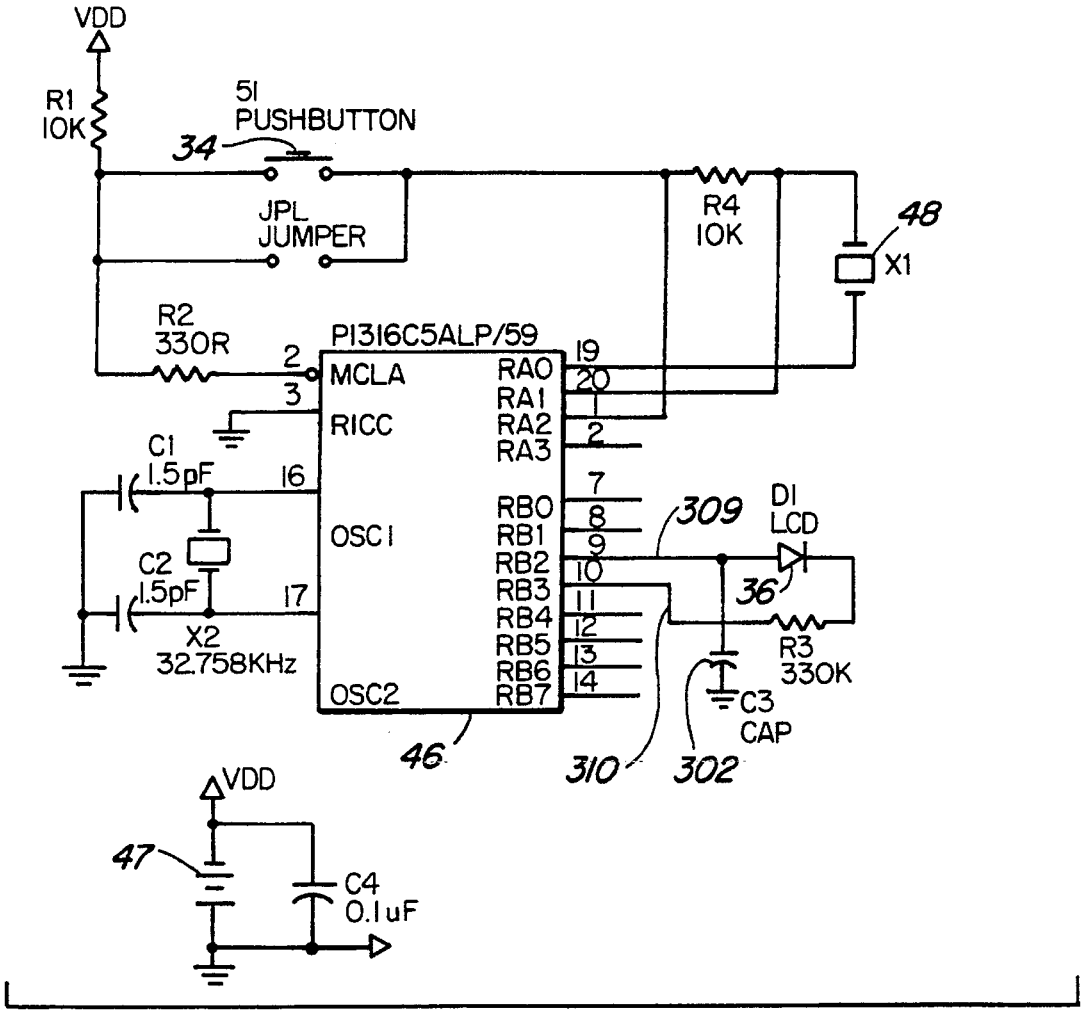
FIG. 3 is a circuit diagram of the module.

A typical circuit diagram of the module 12 is shown in FIG. 3. A microprocessor 46 is provided for receiving and storing alarm information from the programming station 10 through LED 36, for providing visual and auditory alarms signals to sound device 48 and LED 36 and for receiving an alarm silence signal from push button 34. The microprocessor 46 is powered by battery 47. In one embodiment of the invention, the sound device 48 is a piezo crystal driven directly by the microprocessor 46. In another embodiment of the invention, the alarm silence signal is generated by a piezo crystal in place of the push button 34.

Figure 3A:
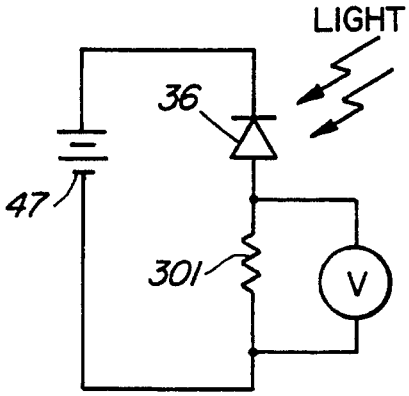
FIG. 3*a* shows a common method of measuring the leakage current through a diode.
Figure 4A:
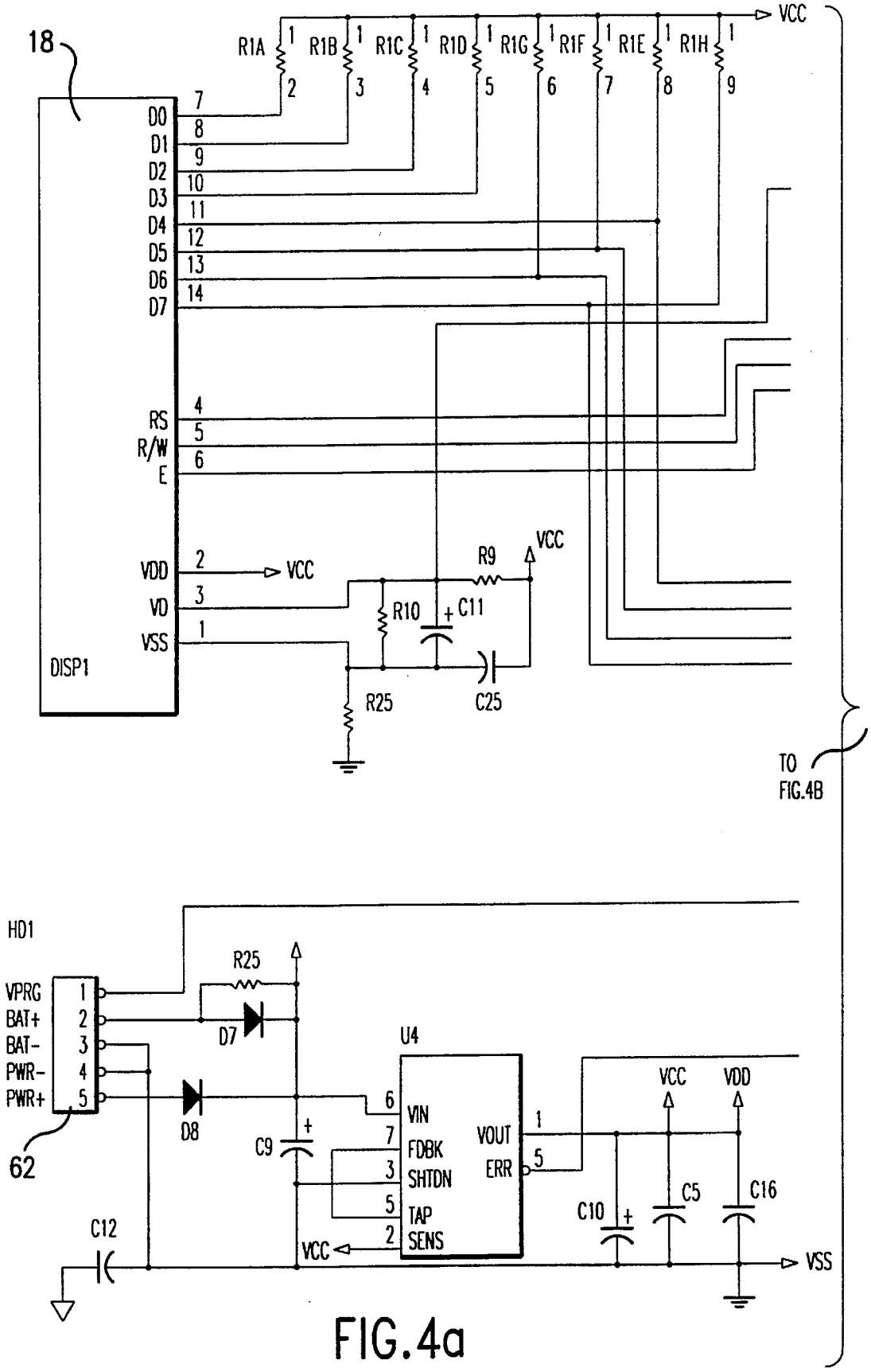
FIG. 4*a* is a first part of a circuit diagram of the module.
Figure 4B:
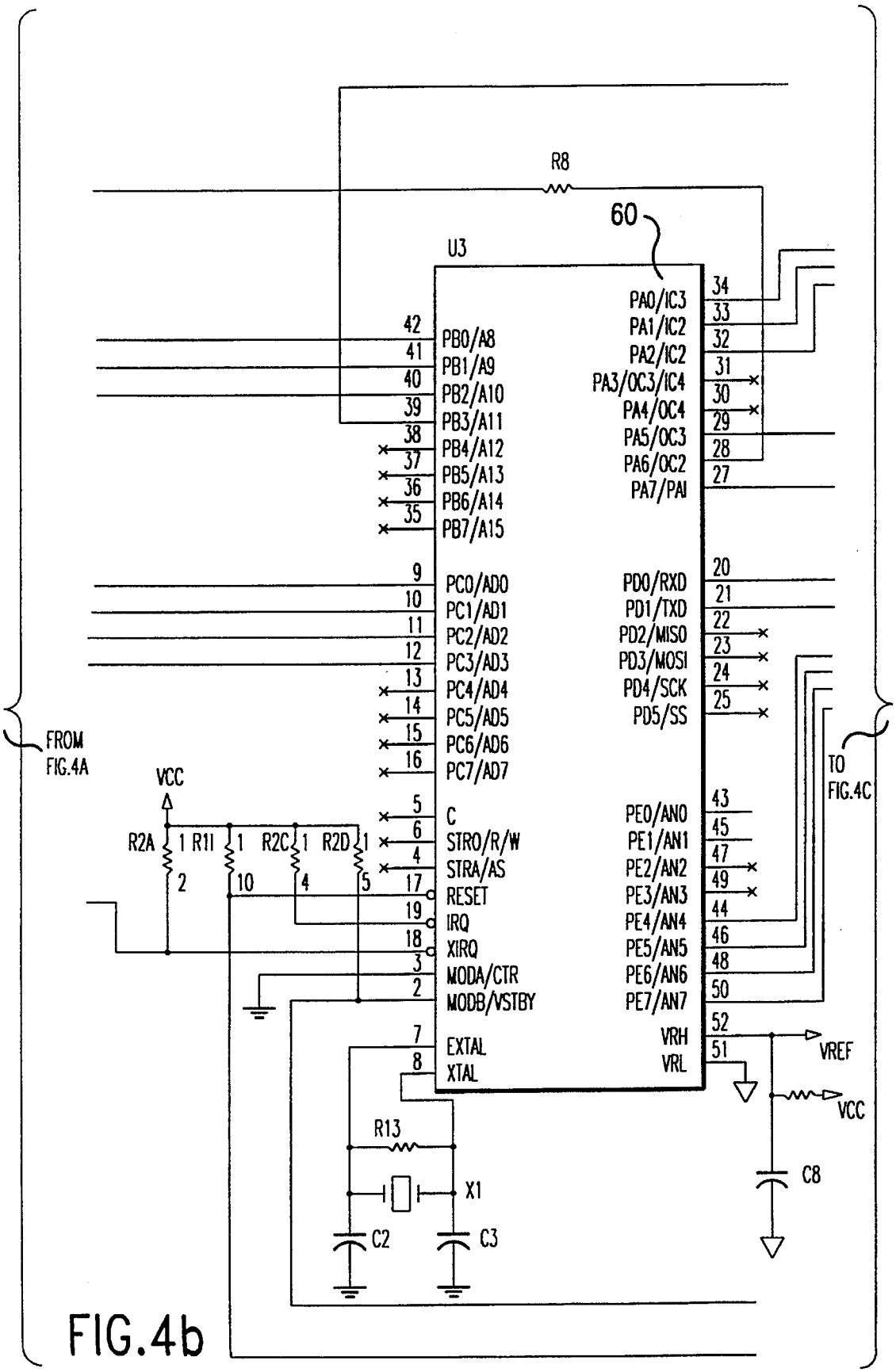
FIG. 4*b* is a second part of a circuit diagram of the programming station.
Figure 4C:
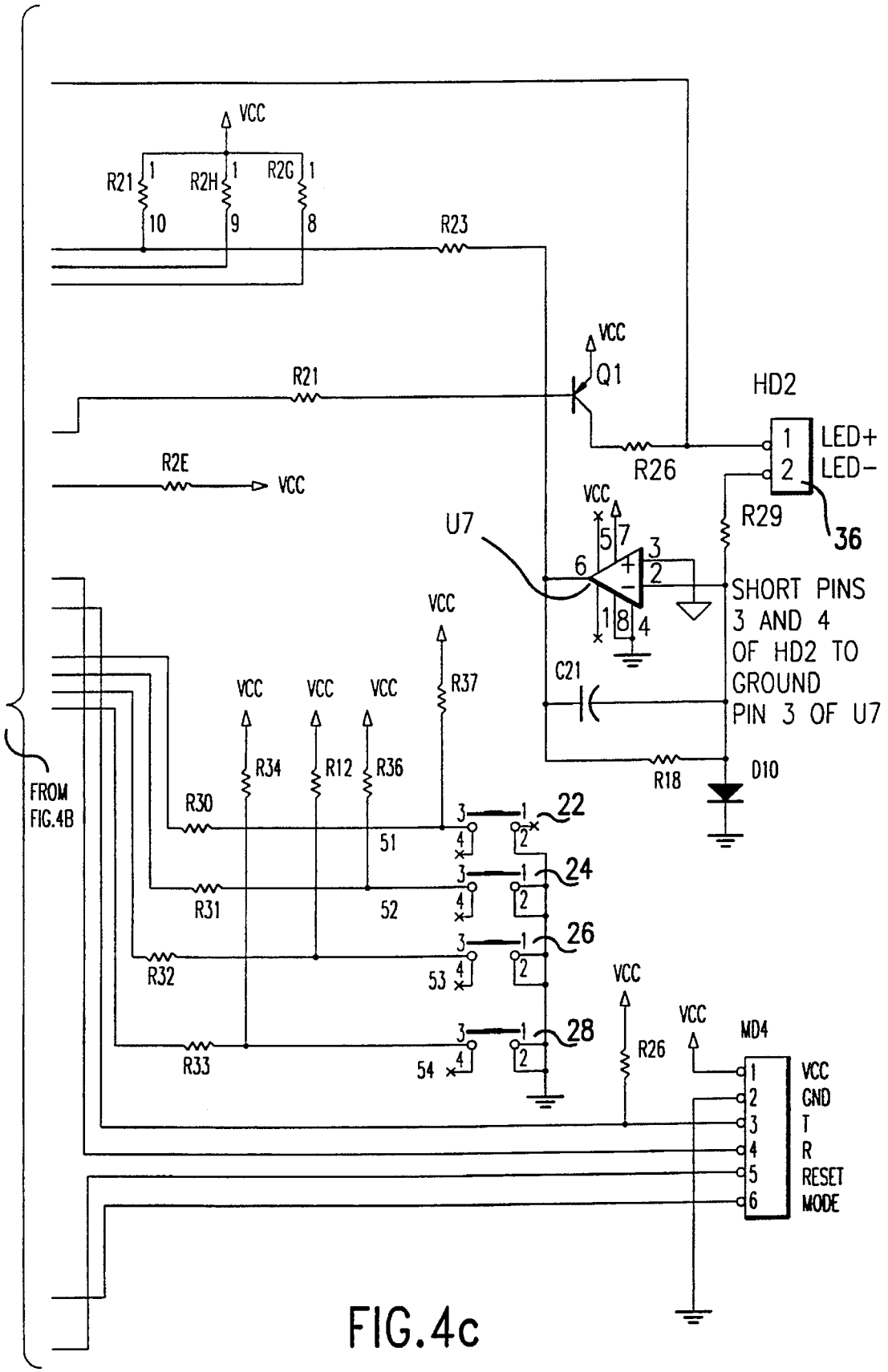
FIG. 4*c* is a third part of a circuit diagram of the module.

In one specific embodiment of the invention, the LED 36 on the module 12 and LED 44 on the programming station 10 provide a bi-directional communication link between the station 10 and module 12. In this embodiment, both LED's 36 and 44 serve as a transmitter and receiver wherein light from one LED induces a current in corresponding LED, both adapted to provide a coded bi-directional communication signal between the respective circuitry of the module 12 and programming station 10. In this embodiment of the invention, the principle of the leakage current across a semiconductor junction being affected by incident light is utilized. A light emitting diode which is normally used to produce light will also operate as a light sensor if a circuit is made to measure the leakage current through the diode. FIG. 3*a* shows a common method of measuring the leakage current through a diode. A reverse bias voltage 47 is provided across the diode 36 and a voltage is produced across a resistor 301 by the leakage current. If the light incident on the light emitting diode is modulated then a modulated voltage will appear on the resistor 301.

In a preferred embodiment of the invention, the diode 36 is reverse biased by providing a positive voltage on a port pin 310 of the microprocessor 46 (Microchip Technology Inc., Part #PIC16C5X). Instead of providing a resistor to detect the leakage current, a capacitor 302 is charged with the leakage current. The microprocessor 46 used in the preferred embodiment has the ability to have its port pins changed from outputs to inputs via software commands. When the presence of incident light is to be detected, the residual voltage on the capacitor can be discharged by setting port pin 309 to an output and then setting its output level to a logic low level. Port pin 309 is then changed to an input via software control. The leakage current through the diode 36 causes the voltage on the capacitor 302 to rise from zero volts toward the supply voltage 47 of the microprocessor 46. The time required for the voltage on the capacitor 302 to reach the logic switching threshold level of the input pin 309 of the microprocessor will depend on the level of the incident light. If the incident light level produced by the LED 44 in the programming station 10 is modulated in an on-off fashion corresponding to a serial data stream of digital information, then the corresponding serial data can be detected on the input pin 309 of the microprocessor 46.

In order to provide two-way communication, the LED 36 in the module 12 can be driven by the microprocessor 46 by setting port pin 309 to an output with a logic high level and setting port pin 310 to an output with a logic low level. The LED 36 is then forward biased and will produce light. The microprocessor 46 can then transmit serial data back to the programming station 10 by modulating the logic level on port pin 310 which will turn the LED 36 on and off.

To receive data from the module 12, the LED 44 in the programming station is used in a similar fashion to detect the serial data being sent by the LED 36 in the module 12.

A typical circuit diagram of the programming station 10 is shown in FIGS. *4a, 4b* and *4c*. The programming station 10 is provided with a microprocessor 60 for programming and downloading alarm instructions to the module microprocessor 46 through the LED 44 and LED 36 interface. The microprocessor 60 receives input signals from keys 22, 24, 26 and 28 and provides display output to display 18. The microprocessor 60 is continuously powered by a battery or power supply connected to a jack 62. The microprocessor 60 operates continuously so as to provide a real-time time-of-day clock function.

The physical configuration of the module 12 may be provided to further enhance the convenience to the patient of using the module 12. In one embodiment, the hole 40 in body 32 may be used to facilitate attachment of the module 12 to a separate article which is regularly carried by the patient, for example, a key ring.

Figure 5:
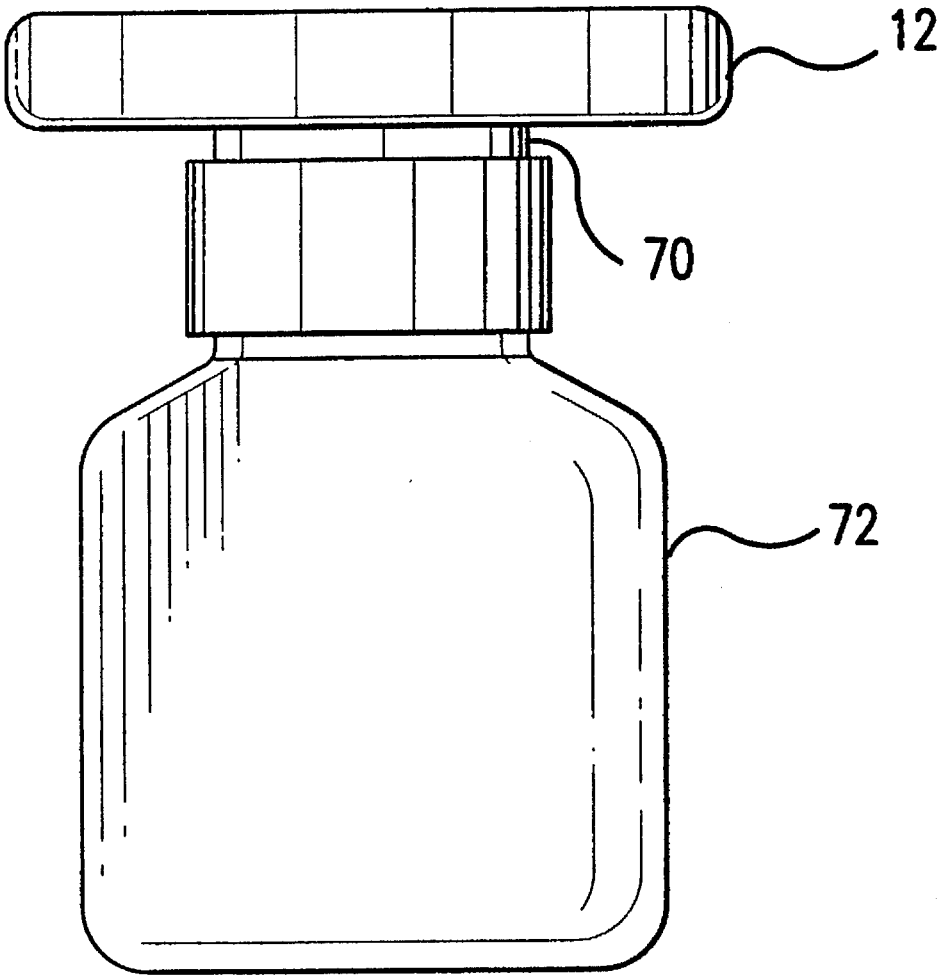
FIG. 5 is a schematic diagram of an alternative embodiment of the module where the module is attached to a lid of a medication container.
Figure 6A:
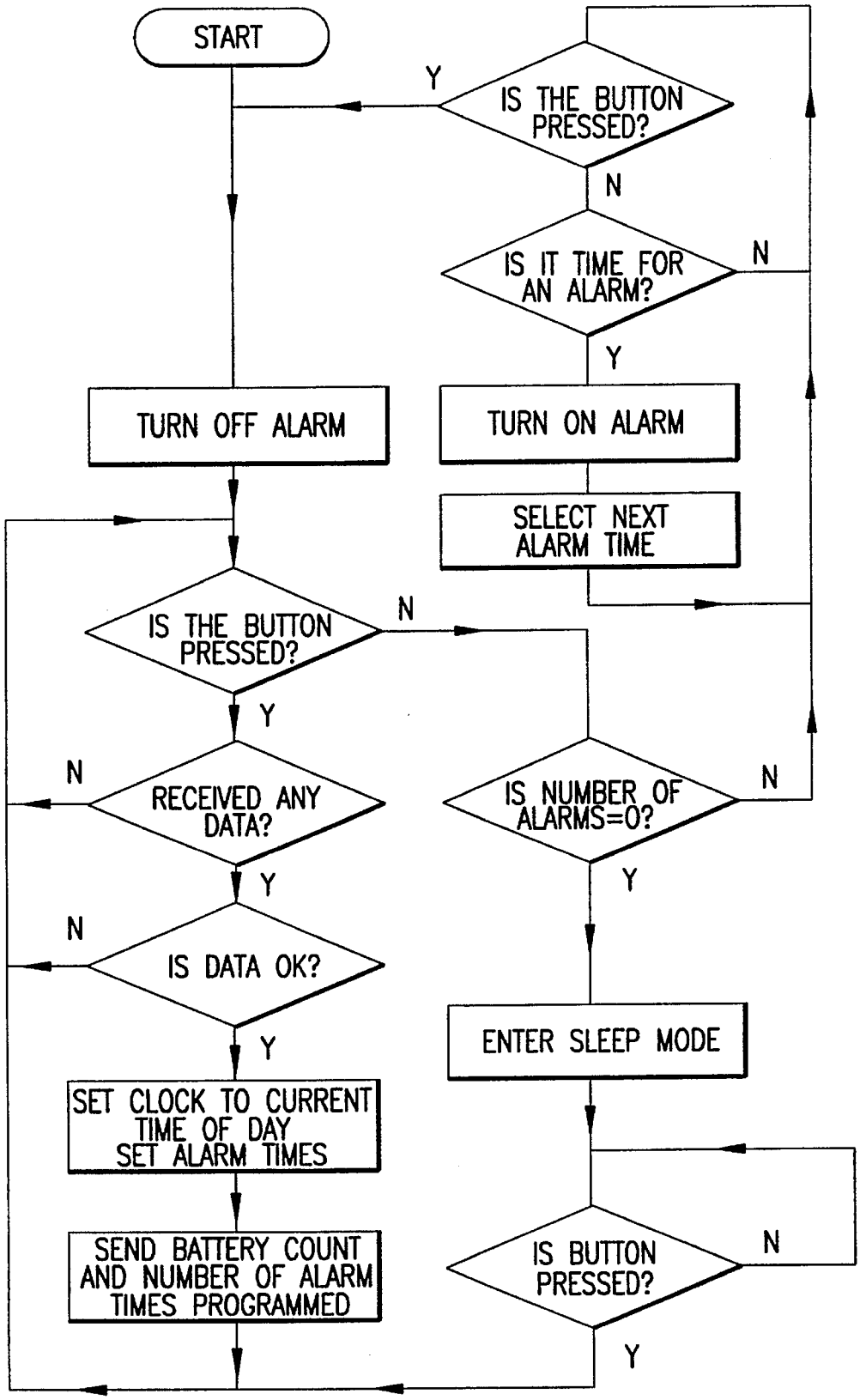
FIG. 6*a* is a flow chart of alarm module operation.
Figure 6B:
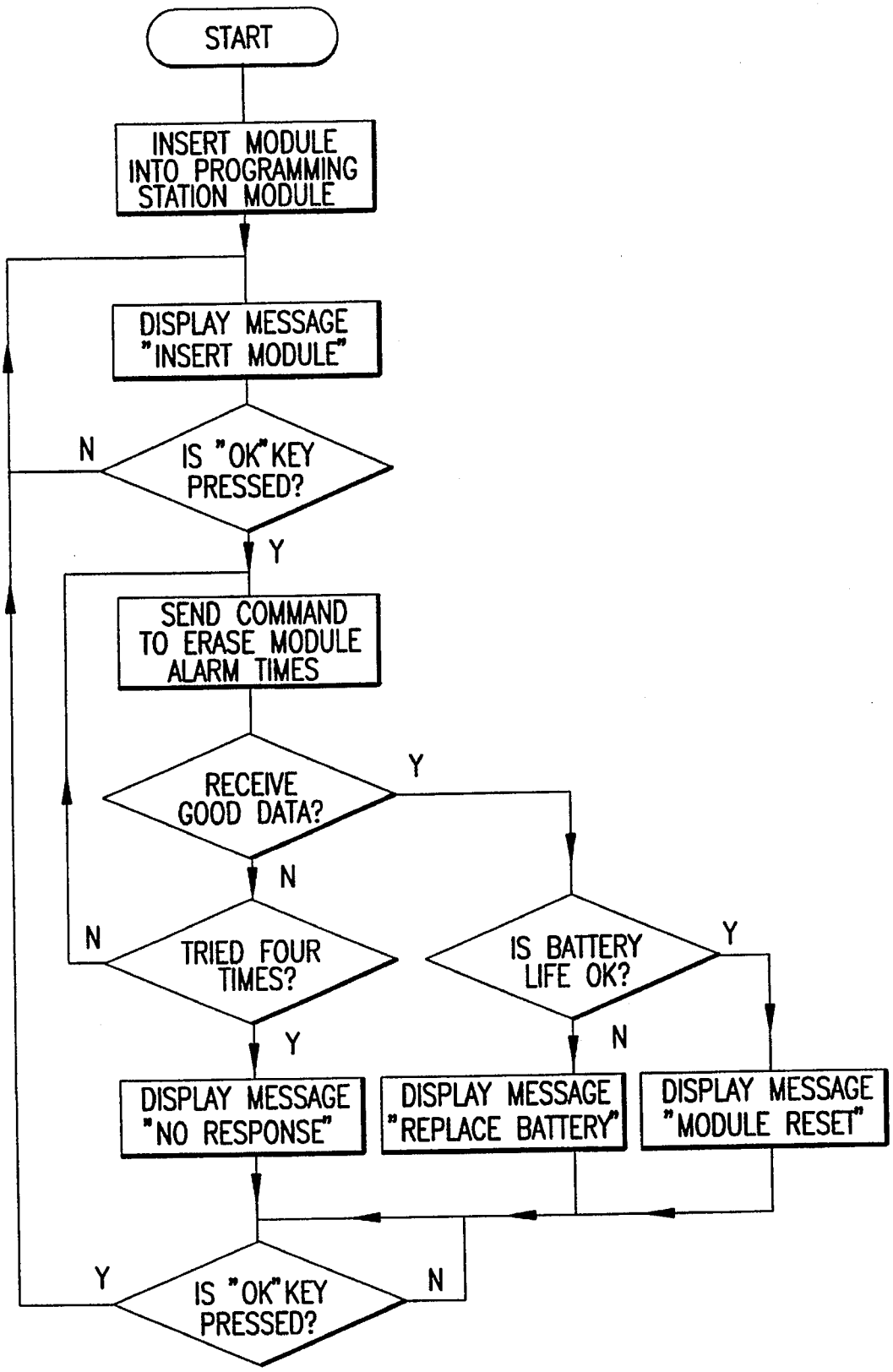
FIG. 6*b* is a flow chart of the programming station erase module mode.
Figure 6C:
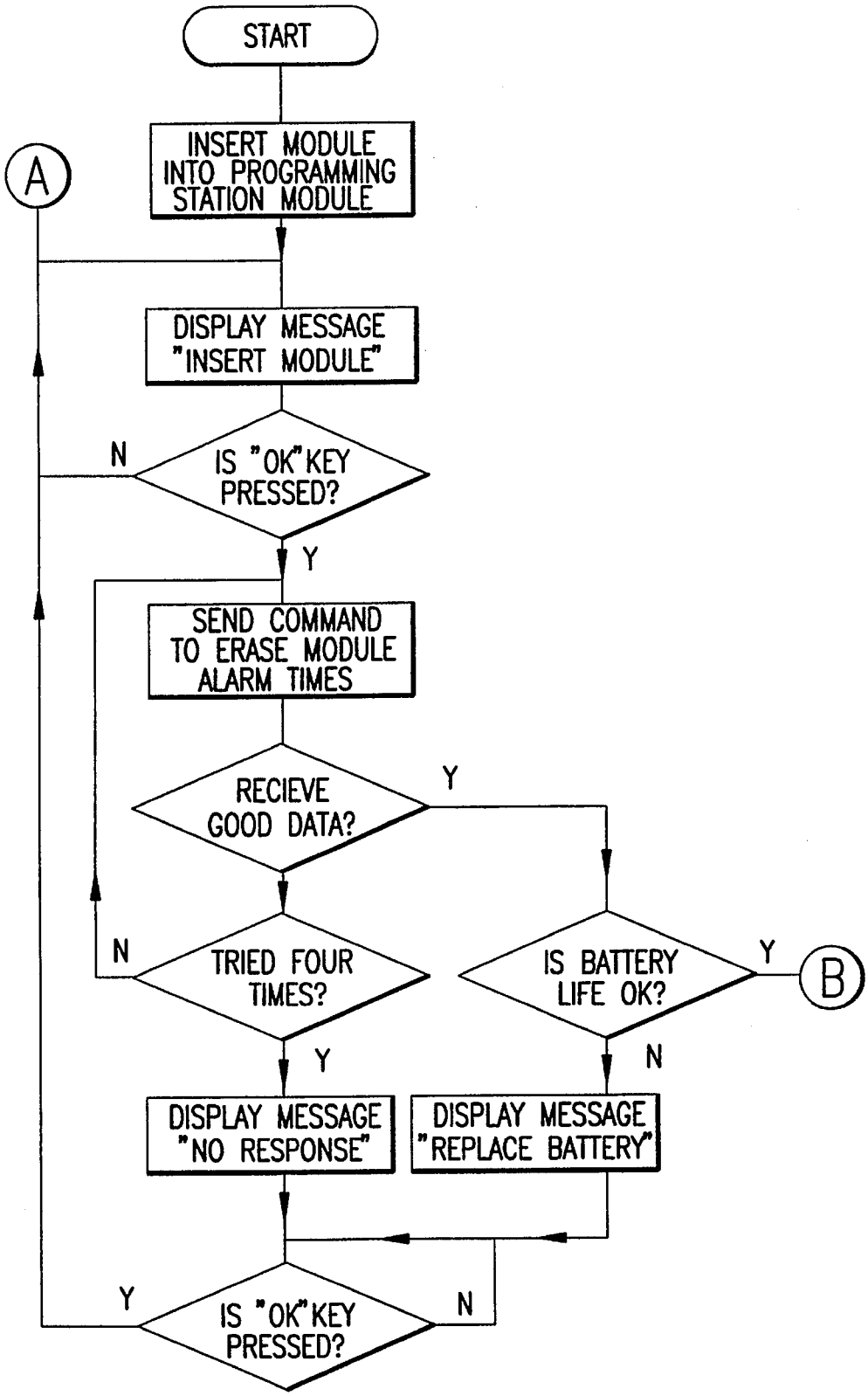
FIG. 6*c* is flow chart of the programming station set prescription time mode.
Figure 6D:
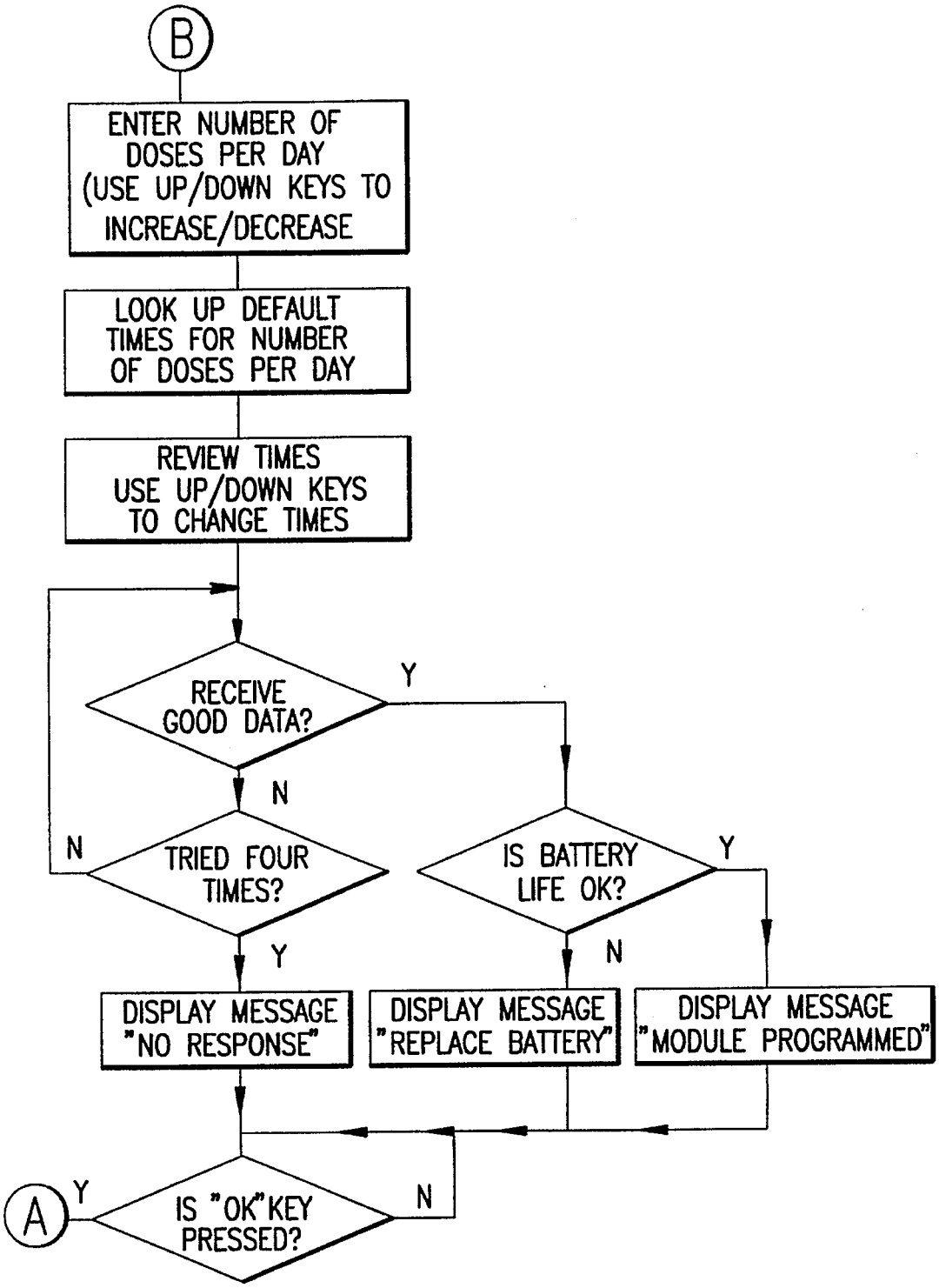
FIG. 6*d* is a flow chart of the programming station set prescription time mode.

Alternatively, the body of the module 12 may be further provided with a lid means 70 to enable the module 12 to be attached directly to a medication bottle 72 as shown in FIG. 5. It is contemplated that the lid means may take numerous forms, such as, but not being limited to, screw or snap lids. Alternatively, the module 12 may be adapted to attach to existing medication container lids. When these embodiments are employed, the patient actively taking several prescriptions may be provided with two or more modules 12, each forming the lid of a different medication bottle. In this situation, the patient may be alerted to the correct time for taking a specific medicine by the visual and auditory alarm on a specific bottle. The body of the module 12 may also be provided with a surface for placing written instructions to the patient relevant to the particular medication.

It is also envisaged within the scope of the invention that alternative embodiments of the alarm may be utilized. These may include but are not limited to amplifiers, large flashing lights and/or vibrators for patients with a visual and/or hearing impairment. Accordingly, it is contemplated that the specific configuration of the module may be realized to provide notification to the patient of the alarm. Similarly, alternative embodiments of the alarm silence means are envisaged including, but not limited to, vibration, light, impact or sound sensors.

In the preferred embodiment of the invention, the alarm is a combination of a blinking light and buzzer.

Operation

In operation, the programming station 10 is located at a central dispensary, for example with a pharmacist. The pharmacist, when filling a patient's prescription and completing the written instructions would initiate programming of the module according to the following illustrative algorithm and as described in FIGS. *6a, 6b, 6c* and *6d*. It is understood that other algorithms may be used without departing from the spirit and scope of this invention.

Programming:

As indicated above, the programming station 10 has a real-time clock that keeps track of hours and minutes in a 12-hour format with the display "A/P" to indicate AM or PM. The "MENU" or "MODE" key is used to scroll through the following modes of operation displayed on the first line of the display 18:

| | |
|---|---|
| 1. ERASE MODULE | (Standby Mode) |
| 2. SET MODULE ALARM | (Sets Alarms) |
| 3. SET CLOCK | (Sets Real-time Clock) |

A particular mode of operation is selected by depressing the "OK" key 28. If the ERASE MODULE mode is selected, then the first line of the display 18 will instruct the pharmacist or operator to INSERT MODULE as shown on the display 18.

The second line of the display 18 shows an instruction and the present time of day in 12 hour format with AM or PM, such as,

PRESS OK 11:38 A

1. Erase Module Mode

If a module 12 is being returned by a patient at the end of their prescription, the module alarm times need to be erased to cease the alarm cycle.

In the ERASE MODULE mode, the two-line display shows:

INSERT MODULE

PRESS OK signalling the pharmacist or operator to insert a module 12 into the receptacle 30. When the operator inserts the module 12 correctly and the OK button is pressed, the module 12 responds to the programming station 10 by sending a battery usage counter value.

The module microprocessor 46 retains a battery counter value that is a measure of the state of charge of the battery 47.

The power consumed by the circuit in the module 12 depends on the state of operation of the module. The module has 3 states of operation.

The first state is a "sleep" mode where the clock of the microprocessor is stopped. This state uses very little power and the battery 47 would last for several years if left in this inactive mode.

The second state is a timing mode where the microprocessor 46 is keeping track of the time of day. This mode consumes power resulting in an estimated battery life of about one year for continuous timekeeping.

The third state is the alarm mode where the audible alarm is driven and the LED is being flashed. This mode consumes the most energy from the battery 47 and would operate for about one month if left alarming continuously.

In the microprocessor 46 there is a battery usage counter that is incremented periodically whenever the microprocessor is in mode 2 or 3. The counter is incremented much more frequently when in mode 3 because the rate of power consumption is much higher. The resulting counter value is representative of the energy consumed from the battery 47.

When the module 12 is inserted into the programming station 10, the module 12 reports the value of the battery usage counter. If the battery 47 has been used so much that it may not reliably last for one more prescription use, then the programming station 10 will provide a warning and refuse 16 program the module. When the battery 47 in the module 12 is replaced, the battery usage counter in the microprocessor 46 is reset.

If the battery counter value indicates that there is not enough battery power remaining for another use, the module 12 will no longer accept further programming and the display will show:

REPLACE BATTERY

PRESS OK

If the module 12 is not inserted, inserted backwards, upside down, or in such a way so that communication is not possible between the programming station 10 and the module 12, the programming station 10 will retry several times and then display the message:

NO RESPONSE

PRESS OK

After acknowledging this problem by pressing OK, the display returns to the main menu and the operator can correct the problem and try again.

It is contemplated that in an alternative embodiment of the invention, the module 12 and programming station 10 could be provided with an additional feature which represents the number of days or number of doses that the prescription will last. In this embodiment, the microprocessor 46 would enter a "sleep" mode and no further alarms would be generated.

If communication between the programming station 10 and the module 12 was successful, then the display 18 will read:

MODULE ERASED

PRESS OK

After acknowledging that the module 12 was erased and set back into the "sleep mode", the programming station display 18 will return to the main menu.

2. Operation of Programming Station for Setting Prescription Times

In the present embodiment, when the module 12 is inserted into the programming station 10 and the OK button 28 is pressed, the programming station 10 ash the module 12 to report the status of the battery usage counter and the mode of operation.

If the module 12 contained a prescription program, then the programming station will send a command to the module to erase the times and command the module 12 to go into "sleep" mode. If the module was already in "sleep" mode then the programming station assumes that the pharmacist or operator wants to program a new set of prescription times into the module.

To program the alarm times, the programming station 10 will request the number of doses per day. The display 18 will show the following message:

DOSES PER DAY 4

PRESS OK

The operator can press the UP 24 and DOWN 26 keys to change the default value of doses to the desired number and then press the OK 28 button.

The programming station 10 will next ask the operator to confirm the time of day for each of the doses. Default times for a standard regimen of 3, 4, 6, etc. doses per day can be offered. A typical message would be displayed as follows:

FIRST TIME . . . 8:00a

PRESS OK

Again the operator can press the UP 24 and DOWN 26 keys to change the default time to the desired time and then press the OK 28 button.

The next time would then be displayed with a request for confirmation.

After all of the alarm times have been reviewed, the programming station then loads the information into the module via the communication link.

If the data is successfully sent to the module then the following message is presented:

MODULE PROGRAMMED

PRESS OK

The module 12 is then removed from the programming station 10 and given to the patient.

Pressing OK will return to the main menu. If the data is not sent successfully, it is re-tried several times and then, if still unsuccessful, the following message is displayed:

PROGRAMMING FAILED

PRESS OK

The operator could attempt to change the module 12, or insert it correctly and then press OK to try to program it again. Pressing MENU will abort the programming and return to the main menu.

3-SET TIME mode:

This mode is provided so that the real time clock in the programming station microprocessor 60 can be adjusted to the current time-of-day. The display 18 will show the following message and the UP and DOWN keys can be used to change the current time of day.

SET TIME OF DAY

PRESS OK hh:mm A

Pressing OK will accept the time setting and return to the standby menu.

Data Sent to the Module

The data sent between the programming station 10 and the module 12 via the optical serial data link using LED 44 and 36 can be formatted as a serial data stream with commonly used one-wire asynchronous half duplex serial communication using start bit(s), data bits and stop bit(s). The data stream may contain synchronization preamble byte(s) and checksum byte(s) as is commonly used with serial communication to ensure that the received data is valid.

The content of the data sent to the module 12 from the programming station 10 is the current time of day and the specific times for each alarm.

The content of the data sent from the module 12 to the programming station 10 is the value of the battery usage counter and the number of alarm times programmed. If the module has been erased and is in "sleep" mode, then the number of alarm times will return to 0 value.

Confirmation that the module has received value data and has been programmed is achieved by the module 12 responding to the programming station 10 by sending back the value of the battery usage counter and the number of alarm times programmed.

In another embodiment of the invention, the data could be encoded using a compression algorithm to reduce the number of bytes of data being transmitted.

In operation, when the module 12 is module is away from the Station 10, the LED 36 provides a flashing visual alarm and the sound port 38 provides an auditory alarm warning a patient that it is time to take the prescribed medicine. Both alarms are silenced by push button 34.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the claims.

The embodiments of the invention in which an exclusive property or privilege is claimed are defined as follows:

1. A medication reminder system for reminding patients to take medications comprising:

a portable module, the portable module having module microprocessor for receiving and storing alarm instructions from a programming station, the module microprocessor also for generating an alarm signal corresponding to the alarm instructions and for receiving an alarm silence signal;

light emitting diode (LED) alarm responsive to the alarm signal for generating a visual alarm, the LED also for communication with the programming station via a two-way optical serial data communication link;

piezo alarm responsive to the alarm signal for generating an auditory alarm;

push-button switch for signalling the module microprocessor to silence the LED and piezo alarms when the LED and piezo alarms are active;

a battery for powering the portable microprocessor wherein the portable microprocessor further monitors battery usage by a battery usage counter, the battery usage counter responsive to elapsed time of operation of the module in a timing mode and alarm mode;

the programming station having programming station LED communication interface for communication with the module LED alarm wherein the portable module is received within the programming station to establish communication with the portable module;

programming station microprocessor for programming and downloading alarm instructions to the module microprocessor through the programming station communication interface and module communication interface;

display and keypad for inputting alarm instructions to the programming station microprocessor.

2. The system as in claim 1 wherein the module further comprises a body having a lid means for engagement with a medication container.

3. A medication reminder system for reminding patients to take medications comprising:

a portable module and a programming station; the portable module having a module microprocessor, the module microprocessor having means for receiving and storing alarm instructions from a programming station, means for generating an alarm signal corresponding to the alarm instructions, means for receiving an alarm silence signal, means for returning alarm data to the programming station for verification and means for maintaining and reporting battery usage data corresponding to elapsed time of operation of the portable module in a tuning mode and alarm mode;

alarm means responsive to the alarm signal for generating an alarm, wherein the alarm means is a visual alarm through the LED;

alarm silence means for signalling the module microprocessor to silence the alarm means when the alarm means is active;

battery for powering the portable microprocessor;

first receiver/transmitter circuit for receiving and transmitting modulated programming and battery usage data between the portable module microprocessor and programming station;

the first receiver/transmitter circuit including:

an LED having a positive and negative pole:

a capacitor connected to the positive pole of the LED for charging with leakage current when the LED is reversed biased:

a transmitter/receiver port on the portable microprocessor for providing a forward bias to the LED and for supplying the LED with modulated programming and battery usage data when the portable microprocessor is in a transmitting mode, tile transmitter/receiver port also for providing a reverse bias to the LED when the portable microprocessor is in a receiving mode;

receiver processing means for processing data received while in the receiving mode;

transmitter processing means for processing programming data while in the transmitting mode; and means for measuring the voltage on the port for determining if the LED is in the receiving or transmitting mode and for setting the receiver processing means and transmitter processing means;

the programming station having programming station microprocessor, the programming station microprocessor having means for receiving alarm instructions, means for downloading the alarm instructions to the module microprocessor, means for receiving verification of alarm instructions from the portable module and means for receiving the battery usage data from the portable module;

keypad for inputting alarm instruction data to the programming station microprocessor;

display for displaying programming information;

second receiver/transmitter circuit for receiving and transmitting modulated programming and battery usage data between the portable module microprocessor and programming station microprocessor, the second receiver/transmitter circuit including an LED having a positive and negative pole;

a capacitor connected to the positive pole of the LED for charging with leakage current when the LED is reversed biased:

a transmitter/receiver port on the programing station microprocessor for providing a forward bias to the LED and for supplying the LED with the modulated programming data when the programming station microprocessor is in a transmitting mode, the transmitter/receiver port also for providing a reverse bias to the LED when the programming station microprocessor is in a receiving mode;

receiver processing means for processing data received while in the receiving mode;

transmitter processing means for processing programming data while in the transmitting mode; and means for measuring the voltage on the port for determining if the LED is in the receiving or transmitting mode and for setting the receiver processing means and transmitter processing means.

4. The system as in claim 3 wherein the alarm means includes an auditory alarm through a piezo crystal.

5. A system for programming a portable module as described in claim 3 wherein the programming microprocessor comprises:

an erase module for erasing data from the portable module;

a check battery status module for determining battery usage data from the portable microprocessor;

a set alarm module for setting portable module alarm times the set alarm module having a number of doses command and time of dose command for determining the portable module alarm times;

a data transfer module for transferring the portable module alarm times from the programming station to the portable module;

a data verification module for verifying receipt of portable module alarm times by the portable module microprocessor;

a set time module for setting time of day in the programming station microprocessor.

* * * * *